United States Patent [19]

Salvarezza

[11] Patent Number: 4,570,564

[45] Date of Patent: Feb. 18, 1986

[54] RAT GUARD

[76] Inventor: Robert M. Salvarezza, 110 Braemar Dr., Hillsborough, Calif. 94010

[21] Appl. No.: 665,121

[22] Filed: Oct. 26, 1984

[51] Int. Cl.[4] ..... B63B 21/12

[52] U.S. Cl. ..... 114/221 R

[58] Field of Search ..... 114/221 R; 292/78 R

[56] References Cited

U.S. PATENT DOCUMENTS

| | | | |
|---|---|---|---|
| 1,363,406 | 12/1920 | Girard | 114/221 R |
| 1,641,345 | 9/1927 | Mead | 114/221 R |
| 2,483,874 | 10/1949 | Bernhard | 114/221 R |
| 2,525,234 | 10/1950 | Mucke | 114/221 R |
| 2,950,700 | 8/1960 | McBride | 114/221 R |
| 2,959,147 | 11/1960 | Reubenstine | 114/221 R |
| 3,016,034 | 1/1962 | Raistakka | 114/221 R |
| 3,753,416 | 8/1973 | Haglund et al. | 114/221 R |
| 3,872,818 | 3/1975 | Salvarezza | 114/221 R |

*Primary Examiner*—Trygve M. Blix
*Assistant Examiner*—Stephen P. Avila
*Attorney, Agent, or Firm*—Owen, Wickersham & Erickson

[57] ABSTRACT

A rat guard for ships' hawsers. A barrier plate has a main open-end slot leading upwardly from its lower edge toward an arcuate hawser-engaging end near its center of gravity, and a through opening near its upper end. A pivot pin is near the upper end of the main slot. A freely swingable closure door has an upper end portion with a recess extending in from one side edge and an arcuate portion for engaging the hawser. This door has a closed slot receiving the pivot pin, so that the door is slidable relative to the plate and pin as well as being pivoted to the pin. The door has a first rope-anchor adjacent to its upper end. Either the door or the plate has a second rope anchor well below its upper end and near one side thereof. A first control rope extends through the through opening and is secured to the first rope-anchor; a second control rope is secured to the second rope-anchor.

15 Claims, 8 Drawing Figures

RAT GUARD

This invention relates to an improved rat guard for use on hawsers of ships, to prevent rats and other rodents on shore for boarding the ships by simply walking along the hawsers.

At one time, the rat guards merely comprised large circular disks, which had to be installed on the ships' hawsers by hand under inconvenient circumstances. They were often ineffective, because large rats were able to place their forelegs on the upper edge, then get all four legs on the upper edge, and then jump down on the other side of the hawser, and therefore, be able to board the ship.

Improvements in this field are represented by U.S. Pat. Nos. 3,753,416, and 3,872,818. These supplied a novel rat guard of generally pentagonal shape, which could be manipulated from the deck by using two small ropes. However, there turned out to be other difficulties which held back their adoption as standard devices.

An object of the present invention is to solve the problems of providing adequate rat guards and to provide rat guards that are capable of relatively easy installation from the deck of the ship.

SUMMARY OF THE INVENTION

The rat guard of this invention comprises a large barrier plate having an upper end, side edges, and a lower edge. It is preferably generally pentagonal in shape. A main open-end slot leads upwardly from the lower edge and narrows toward an arcuate hawser-engaging end near the center of gravity of the plate. The plate also has a through opening near its upper end for one of the small central ropes. The plate also has a pivot pin near the upper end of said main slot.

A freely swingable closure door, larger and heavier at a lower end portion, has an upper end portion with a recess therein forming an arcuate portion for engaging a hawser on the opposite side from the arcuate end of the main slot. This door has a closed slot receiving the pivot pin, so that the door is slidable relative to the plate and the pin, as well as being pivoted to the plate. The door has a rope-anchor adjacent to its upper end, for one of the control ropes. Either the door or the plate has an anchor for the second control rope, well below the plate's upper end and near one side edge thereof.

There are two control ropes, both of which are much smaller than the hawser. The first rope extends through the rope opening of the plate and is secured to the first rope-anchor and is used for lowering the rat guard from the deck down toward the hawser. The second rope is secured to the second rope-anchor. These control ropes serve to align the main slot with the hawser so that the lowered rat guard engages the hawser at the arcuate upper end of the main slot. They also serve to bring the rat guard to its proper erect position and to cause the door to close the main slot by pivoting and sliding relative to the pivot pin, thereby engaging the hawser with the arcuate portion of the door.

DESCRIPTION OF SOME PREFERRED EMBODIMENTS

Figure 1:
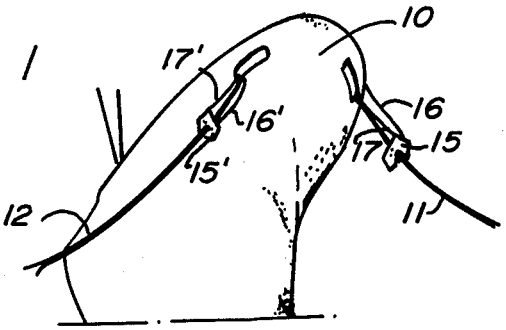
FIG. 1 is a view in perspective of a ship with rat guards embodying the principles of the invention installed on hawsers thereof.
Figure 2:
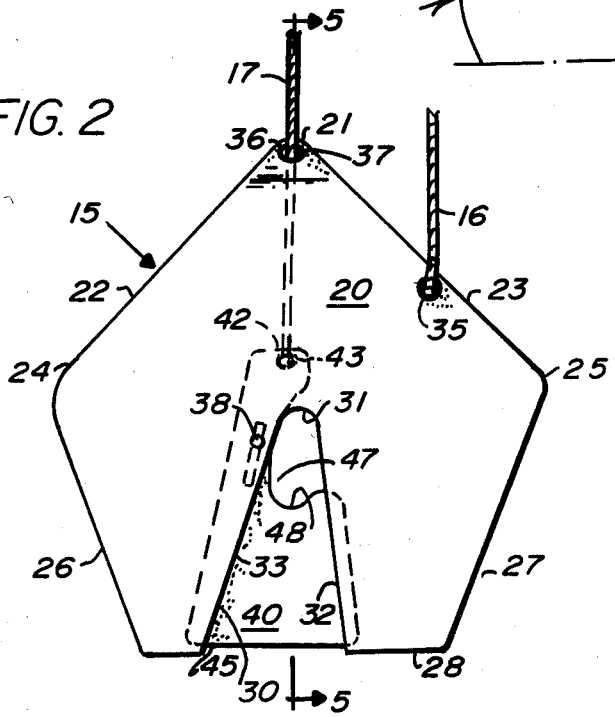
FIG. 2 is a view in front elevation of a rat guard embodying the principles of the invention. The two manipulating ropes are cut off to conserve space.
Figure 5:
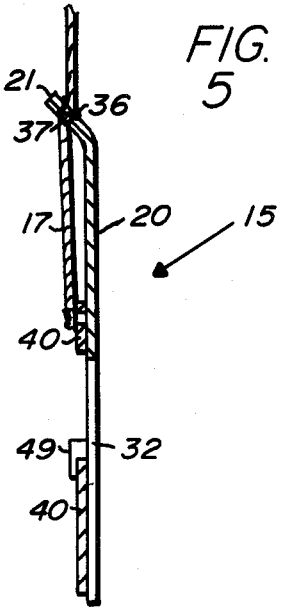
FIG. 5 is a view in section taken along the line 5—5 in FIG. 2.
Figure 3:
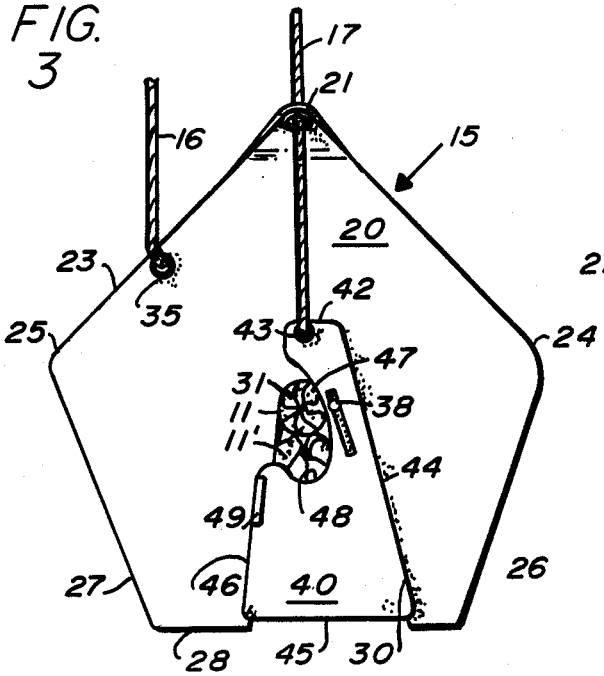
FIG. 3 is a view in rear elevation of the rat guard of FIG. 2, with twin hawsers shown installed, the hawsers being shown in section.
Figure 4:
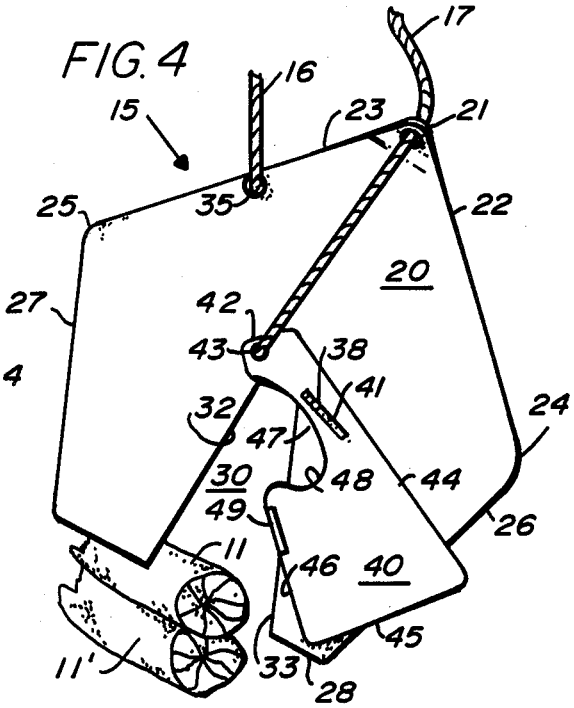
FIG. 4 is a view in rear elevation during installation of the rat guard, showing how the door is automatically opened and so that hawsers can enter the main slot.

FIG. 1 shows a ship 10 having a pair of hawsers 11 and 12 that are secured to a capstan on a deck (not shown).

Rat guards 15 and 15' of the present invention are installed along these hawsers 11 and 12 with the aid of guide ropes 16 and 17, and 16' and 17'.

FIGS. 2 through 5 illustrate a preferred form of the invention. The rat guard 15 shown in FIGS. 2 to 5 comprises a large generally pentagonally shaped plate 20, which is usually called a barrier plate. This plate 20 has an upper end 21, from which lead two side edges 22 and 23 extending out to rounded vertices 24 and 25, and inside edges 26 and 27 lead from the vertices 24 and 25 to a bottom edge 28. The bottom edge 28 has a tapered slot 30 extending upwardly therefrom to an arcuate upper slot end 31. One edge 32 may be nearly vertical, while the other edge 33 is more sloping, to help move the rope up it.

About halfway between the upper end 21 and the vertex 25 is a grommet 35 to which one of the control ropes 16 is secured. Alternatively, the grommet 35 may be located near the edge at a point somewhat lower, down to as low as opposite the vertex 25, if desired, but the preferred location has advantages, as will be explained below. The other rope 17 passes through a grommet 36 providing an opening through an upper plate portion 37 which is bent back, so as to offset the grommet 36 enough that the rope 17 will not bind against the plate 20, or in fact, even touch it. The plate 20 also has a pivot pin 38 which is to one side of the main slot 30 and near the upper end 31 thereof, though not above it.

The rat guard 15 also includes a freely swingable closure door 40 having a somehwat diagonally extending linear slot 41 that engages the pivot pin 38 in such a way that the door 40 can both pivot about the pin 30 and slide up and down with respect to it so as to accommodate and fit the hawser or hawsers 11, 11'. The door 40 is made to be a little wider than the main slot 30 so as to close off slot 30 in the normal, closed position of the door 40. The door 40 has an upper end 42, at which the end of the rope 17 is secured by means of a grommet 43. From the upper end 42, a sloping edge 44 leads to a bottom edge 45. On the other side of the bottom edge 45, a sloping edge 46 leads up to a recess 47 providing a lower arcuate portion 48 for engaging the hawser 11 or 11'. Along the edge 46 is a flange portion 49, perpendicular to the rest of the door 40, which acts actively to prevent the door 40 from accidentally going from the rear side of the plate 20 to the front side, thereby confusing the situation. This flange 49 keeps the door 40 at all times on the rear side of the plate 20.

In operation, the rat guard 15 of FIGS. 2 to 5 is manipulated by its two ropes 16 and 17. When the rat guard 15 is lowered toward the hawser 11 (shown in FIGS. 3 and 4 as twin hawsers 11 and 11'), the rope 17 is allowed to have some slack (see FIG. 4) so that the rat guard 15 is held mainly by the rope 16 that is secured near one edge of the plate 20 to the grommet 35. This results in the position shown in FIG. 4, in which the plate 20 is tilted about 22½° while the door 40 hangs vertically and opens the slot 30. The door 40 hangs vertically due to its own gravity, and the plate 20 is tilted due to the control rope 16 being taut while the other control rope 17 is slack. The preferred location of the grommet means that the rat guard 15 need tilt only 22° and is therefore easier to guide into position. In this way the slot 30 can be maneuvered so that its edges 32 and 33 are on opposite sides of the hawsers 11, 11', and then the rope 16 is lowered a little further to send the hawsers 11, 11' up into the slot 30. When the hawsers 11, 11' approach the upper end 31 of the slot 30, the rope 17 is tightened to straighten up the rat guard 15 to the position shown in FIG. 3 and also to close the door 40. The control ropes 16 and 17 are then tied, and the rat guard 15 is safely in position.

Figure 6:
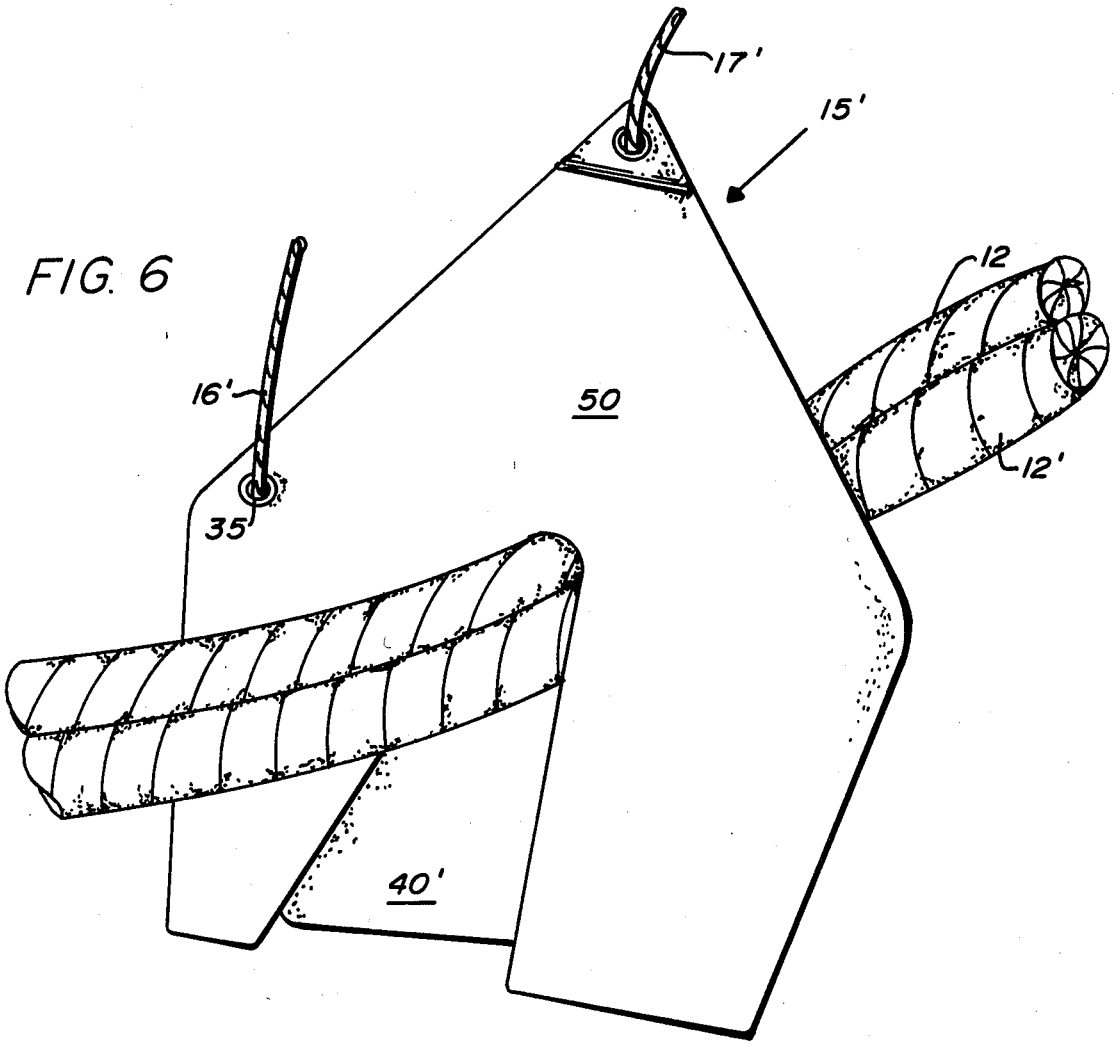
FIG. 6 is a view in front elevation of a modified form of rat guard also embodying the principles of the invention, showing the hawsers in place and with the control ropes and hawsers broken off.
Figure 7:
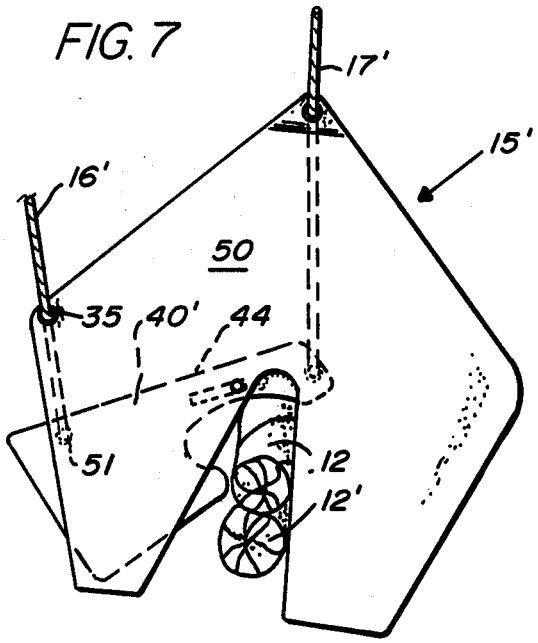
FIG. 7 is a view similar to FIG. 6 on a smaller scale, showing the door opened and the hawsers being installed.
Figure 8:
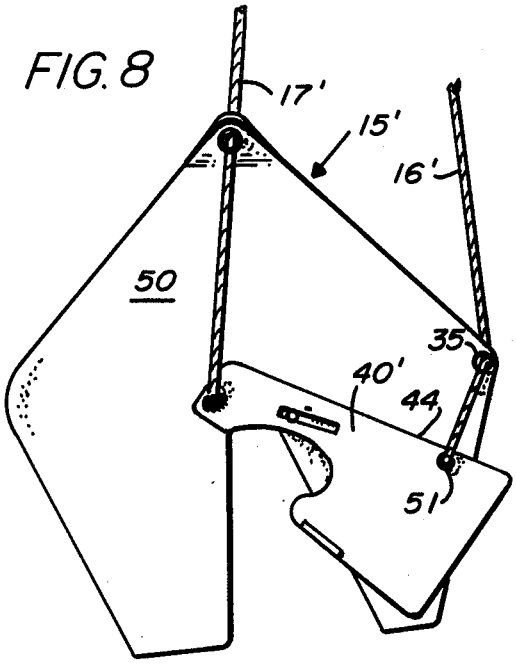
FIG. 8 is a view in rear elevation of the rat guard of FIGS. 6 and 7, omitting the hawsers.

The alternative embodiment, the rat guard 15' shown in FIGS. 6 through 8 is in many ways the same, and its plate 50 may be substantially identical in construction to the plate 20, although it is shown here with some small differences. The door 40' also can be substantially identical to the door 40, except that it has a grommet 51 near its long side edge 44, to which the end of the rope 16' is secured. Thus, in this form of the invention, the rope 16' passes through the grommet 35 of in the plate 50, rather than being tied to it, and is secured to the grommet 51 in the door 40'. The operation is substantially the same, through the ropes 16' and 17' in this case are operated somewhat differently, in that the door 40' is positively lifted out of the way by the rope 16' and when the hawsers 12, 12' are properly engaged, the door 40' is closed by letting the rope 16' become slack, the door 40' then automatically going into its closed position.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A rat guard for ships' hawsers and the like, including in combination:

a large barrier plate having an upper end, side edges, and a lower edge and having a main open-end slot leading upwardly from said lower edge toward an arcuate hawser-engaging end near the center of gravity of said plate, said plate also having a through opening near said upper end and said plate having a pivot pin near the upper end of said main slot, a freely swingable closure door larger and heavier at a lower end portion and having an upper end portion with a recess extending in from one side edge and having an arcuate portion for engaging said hawser on its side opposite the arcuate end of said main slot, said door having a closed rectilinear slot receiving said pivot pin so that said door is slidable without rotation relative to said plate and pin as well as being pivoted to said pin, said door having first rope-anchoring means adjacent to its upper end, one of said door and plate having second rope anchoring means well below its upper end and near one side thereof, a first control rope extending through said through opening and secured to said first rope-anchoring means, for lowering said guard from deck down toward a hawser, and a second control rope secured to said second rope-anchoring means, said ropes serving for aligning said main slot with said hawser and opening said door so that the lowered guard engages said hawser at the arcuate upper end of said slot, and for righting said guard and causing said door to close said main slot by pivoting and sliding relative to said pivot pin and to engage said hawser with said arcuate portion.

2. The rat guard of claim 1 wherein said second rope anchoring means is on said plate near one side edge and between about half and three quarters of the way up between said lower edge and said upper end.

3. The rat guard of claim 1 wherein said plate has a second through opening near one side edge and about half way between said upper end and said lower edge, said second rope anchoring means being on said door near its lower end.

4. The rat guard of claim 1 wherein said main slot is tapered, narrowing from said lower edge toward said hawser-engaging end.

5. The rat guard of claim 1 wherein said closed slot extends generally vertically but somehwat at an angle.

6. The rat guard of claim 1 wherein said door has a flange perpendicular thereto extending away from said plate along the side edge having the recess and below said recess.

7. A rat guard to ships' hawsers and the like, including in combination:

a large barrier plate having a bent-out upper end, side edges, and a lower edge and having a main open-end slot leading upwardly from said lower edge toward an arcuate hawser-engaging end near the center of gravity of said plate, said plate also having an opening through the bent-out upper end and first rope-anchoring means slightly above said center of gravity near one said side edge, said plate having a pivot pin near the upper end of said main slot, a freely swingable closure door larger and heavier at a lower end portion and having an upper end portion with a recess extending in from a side edge and having an arcuate portion for engaging said hawser on its side opposite the arcuate end of said main slot, said door having a closed rectilinear slot receiving said pivot pin, so that said door is slidable rectilinearly relative to said plate and pin as well as being pivoted to said pin, said door having second rope-anchoring means adjacent to its upper end, a first control rope secured to said first rope-anchoring means, for lowering said guard from a ship's deck down toward a hawser and aligning said main slot with said hawser so that the guard, when further lowered, engages said hawser at the arcuate upper end of said slot, and a second control rope secured to said second rope-anchoring means and extending through said plate's through opening, for righting said guard and causing said door to close said main slot by pivoting and sliding relative to said pivot pin and to engage said hawser with its said arcuate portion.

8. The rat guard of claim 7 wherein said main slot is tapered, narrowing from said lower edge toward said hawser-engaging end.

9. The rat guard of claim 7 wherein said closed slot normally extends generally vertically and somehwat at an angle.

10. The rat guard of claim 7 wherein said door has a flange extending out perpendicular to said plate and away therefrom along the side edge having the recess, said flange being below said recess.

11. The rat guard of claim 7 wherein said plate is pentagonal with one vertex at said upper end, two at said lower edge, and two along said side edge and first rope-anchoring means comprises a grommet located adjacent said side edge about half way between said upper end and the vertex lying along said side edge.

12. A rat guard to ships' hawsers and the like, including in combination:

a large barrier plate having a bent-out upper end, side edges, and a lower edge and having a main open-end rectilinear slot leading upwardly from said lower edge and toward an arcuate hawser-engaging end near the center of gravity of said plate, said plate also having a first opening through said bent-out upper end and a second through opening slightly above said center of gravity near one said side edge, said plate having a pivot pin near the upper end of said main slot, a freely swingable closure door larger and heavier at a lower end portion and having an upper end portion with a recess extending in form one side edge and having an arcuate portion for engaging said hawser on its side opposite the arcuate end of said main slot, said door having a closed slot receiving said pivot pin so that said door is slidable rectilinearly relative to said plate and pin as well as pivoted to said pin, said door having first rope-anchoring means adjacent to its upper end, and second rope-anchoring means adjacent to its said lower end, a first control rope extending through said first through opening and secured to said first rope-anchoring means, for lowering said guard from deck down toward a hawser and aligning said main slot with said hawser, and a second control rope extending through said second through opening and secured to said second rope-anchoring means for opening said door so that said hawser can enter said main slot and for causing said door open release to close said main slot by said door's pivoting and sliding relative to said pivot pin so that it engages said hawser with its said arcuate portion.

13. The rat guard of claim 12 wherein said main slot is tapered, narrowing from said lower edge toward said hawser-engaging end.

14. The rat guard of claim 12 wherein said closed slot normally extends generally vertically and somewhat at an angle.

15. The rat guard of claim 12 wherein said door has a flange perpendicular to said plate and extending away therefrom, said flange being along the side edge having the recess and being below said recess.

* * * * *

UNITED STATES PATENT AND TRADEMARK OFFICE

CERTIFICATE OF CORRECTION

PATENT NO. : 4,570,564

DATED : February 18, 1986

INVENTOR(S) : Robert M. Salvarezza

It is certified that error appears in the above-identified patent and that said Letters Patent are hereby corrected as shown below:

Column 2, line 25, "deck" should read --dock--.
Column 4, line 45, which is line 1 of claim 7, "guard to" should read --guard for--.
Column 5, line 15, which is line 2 of claim 9, "somehwat" should read --somewhat--.
Column 5, line 28, which is line 1 of claim 12, "guard to" should read --guard for--.
Column 5, line 33, which is line 5 of claim 12, delete "rectilinear".
Column 6, line 8, which is line 18 of claim 12, after "closed" and before "slot" insert --rectilinear--.
Column 6, line 24, which is the 4th line from the end of claim 12, "open" should read --upon--.

Signed and Sealed this

*Twenty-fourth* Day of *June 1986*

[SEAL]

*Attest:*

DONALD J. QUIGG

*Attesting Officer*

*Commissioner of Patents and Trademarks*